US006390580B1

(12) United States Patent
Anderson et al.

(10) Patent No.: US 6,390,580 B1
(45) Date of Patent: May 21, 2002

(54) PRINTHEAD REGISTRATION APPARATUS AND METHOD

(75) Inventors: Daryl E. Anderson; Jeffery S. Beck; Dennis J. Schloeman, all of Corvallis, OR (US)

(73) Assignee: Hewlett-Packard Company, Palo Alto, CA (US)

( * ) Notice: Subject to any disclaimer, the term of this patent is extended or adjusted under 35 U.S.C. 154(b) by 0 days.

(21) Appl. No.: 09/300,795

(22) Filed: Apr. 27, 1999

(51) Int. Cl.[7] ..... B41J 29/38
(52) U.S. Cl. ..... 347/9; 347/12
(58) Field of Search ..... 347/14, 15, 12, 347/13, 40, 42, 56–59, 90

(56) References Cited

U.S. PATENT DOCUMENTS 4,513,299 A * 4/1985 Lee et al. ..... 347/15
4,872,028 A 10/1989 Lloyd ..... 347/14
5,322,594 A * 6/1994 Bol ..... 156/634
5,408,746 A 4/1995 Thoman et al. ..... 29/890.1
5,635,968 A * 6/1997 Bhaskar et al. ..... 347/59
5,682,185 A 10/1997 Wade et al. ..... 347/19
5,726,690 A 3/1998 Bohorquez et al. ..... 347/15
5,867,200 A * 2/1999 Tajima et al. ..... 347/211
5,975,670 A * 11/1999 Kikuta et al. ..... 347/15
6,102,513 A * 8/2000 Wen ..... 347/15
6,120,123 A * 9/2000 Tanaka ..... 347/15
6,243,109 B1 * 6/2001 Ishinaga et al. ..... 347/3

* cited by examiner

*Primary Examiner*—John Barlow
*Assistant Examiner*—Alfred E. Dudding

(57) ABSTRACT

A printing apparatus having a plurality of printing devices (e.g., printheads or firing chambers) that permits registration of the printing devices so as to achieve a uniform output of print ink. Logic that adjusts the length of a firing signal (which is related to drop size) and timing of a firing signal is disclosed.

22 Claims, 2 Drawing Sheets

PRINTHEAD REGISTRATION APPARATUS AND METHOD

FIELD OF THE INVENTION

The present invention relates to printers and, more specifically, to registration of multiple printheads and/or multiple firing chambers in a printer.

BACKGROUND OF THE INVENTION

Many types of printers are known and they include ink jet, laser and various thermal and impact printers. Ink jet printers include those that are thermally actuated (e.g., resistive element) and those that are mechanically actuated (e.g., piezo-electric element). Representative ink jet printers include those made by Hewlett Packard, Canon and Epson, etc. The multiple printhead and/or multiple firing chamber registration techniques of the present invention are applicable to all printers and particularly to ink jet printers.

The present invention is directed towards the registration of printing devices within a printer. This registration may be manifested in many ways. A few of these ways are now presented for pedagogical purposes. Multiple printheads or printheads with multiple firing chambers are utilized as a way of delivering color printing (one primary or equivalent color per printhead) and of increasing printing speed and coverage area, amongst other features.

In a thermally actuated multiple printhead printer, the ink expulsion elements are usually formed as resistors in a semiconductor substrate. Due to variations in the semiconductor fabrication process, the size of these resistors may vary between wafers and even between dies from the same wafer. Since different size resistors have different power draws, the same firing current delivered to two different resistors will produce different magnitude thermal pulses and hence different sized ink drops. The different sized ink drops in turn result in printed images that are more strongly of one color than another, for example.

Another relevant registration consideration arises when multiple printheads (or multiple firing chambers in a single printhead) are used in a printing apparatus that prints on a curved surface, e.g., a plotter or other printer with a roll bar. A flat printing device surface used in conjunction with a curved printing surface will normally result in some of the printheads or firing chambers being situated closer to the print media than others. Since it will take longer for ink from the more distant printheads or chambers to arrive at the print media, ink drops will not align appropriately, thus resulting in reduced image quality.

A need thus exists to provide registration in multiple printhead or firing chamber printers so that similarly sized ink drops are delivered in a timely manner to print media.

SUMMARY OF THE INVENTION

Accordingly, it is an object of the present invention to provide a printing apparatus that provides registration of printhead and/or firing chambers to achieve improved image quality.

It is another object of the present invention to provide a printing apparatus that increases the uniformity of the size of ink drops delivered to print media.

It is also an object of the present invention to achieve such registration and related benefits by modifying the timing and/or strength of firing signals delivered to ink expulsion elements.

These and related object of the present invention are achieved by use of a printhead registration apparatus and method as described herein.

The attainment of the foregoing and related advantages and features of the invention should be more readily apparent to those skilled in the art, after review of the following more detailed description of the invention taken together with the drawings.

DETAILED DESCRIPTION

Figure 1:
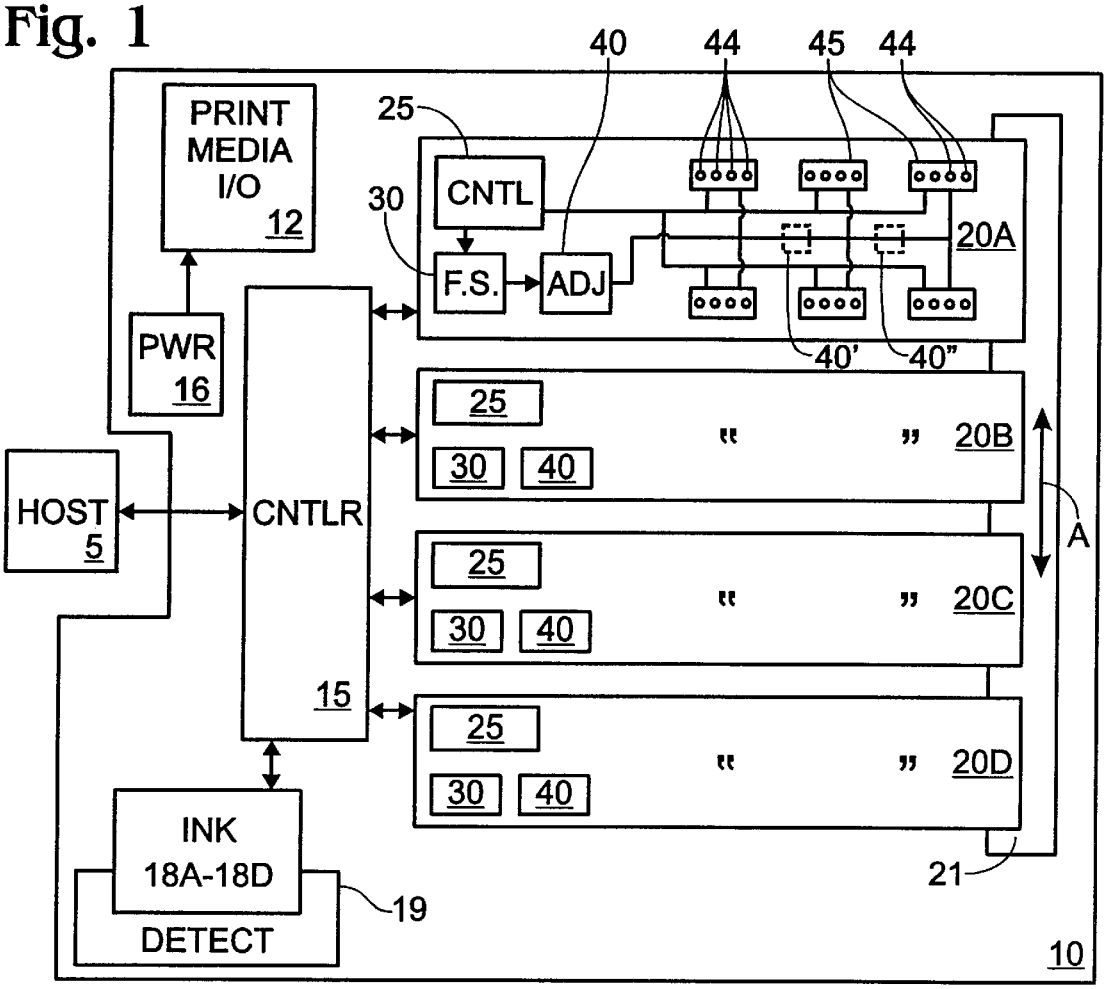
FIG. 1 is a schematic diagram of a printer having multiple printing devices in accordance with the present invention.

Referring to FIG. 1, a schematic diagram of a printer 10 having multiple "printing devices" 20 in accordance with the present invention is shown. In the description of FIG. 1 that follows, the printing devices 20 are described as being printheads. It should be recognized, however, that the term printing device as used herein also includes firing chamber (a multiplicity of which may be provided in a single printhead) and is generally intended to include any ink expulsion arrangement that may benefit from the firing signal control taught herein.

Printer 10 includes a plurality of printheads 20 that are individually identified as printheads 20A–20D. These printheads are preferably formed in a semiconductor substrate. The printheads are preferably provided in a movable carriage 21, though they may be provided in a stationary manner, e.g., formed wide enough to cover a sheet of paper or other print media. Two headed arrow A illustrates transverse movement of carriage 21. Printer 10 also preferably includes a controller 15 (to which the printheads are preferably coupled), print media input/output (I/O) unit 12, power supply 16 and an ink supply 18.

Suitable controller logic for performing typical printer/printhead functions is known in the art. It should be recognized, however, that logic for performing functions of the present invention may be provided in the controller, though such embodiment may result in increased EMI and require a sufficiently fast master clock.

The print media I/O unit preferably includes paper input and output trays, guides, and appropriate sensors and transport mechanisms, etc. Power supply 16 provides regulated DC at appropriate voltage levels.

Ink supply 18 preferably provides an appropriate ink supply 18A–18D, respectively, for printheads 20A–20D. Individual ink supply components may be formed integrally with their corresponding printheads or formed separately therefrom. Ink supplies 18A–18D may be provided in a refillable or replaceable manner. Ink level detection logic 19 is preferably provided with the ink supplies to indicate an ink volume level. Suitable ink supply arrangements are known in the art.

Printer 10 preferably receives print data from a host machine 5 which may be a computer, facsimile machine, Internet terminal, camera, plotter or other device that is capable of propagating print data to printer 10.

Each of printheads 20A–20D preferably include a plurality of firing chambers that each have an associated ink expulsion point or nozzle 44. The nozzles may be grouped into primitives 45 which are subsets of nozzles in which only one nozzle (or less than all nozzles) is fired per firing interval. While FIG. 1 illustrates four nozzles per primitive, more or less than this number may be provided. The use of primitives may decrease power consumption and lead interconnects and may address fluidic concerns.

Fire signal generation logic 30 preferably generates a firing signal for each nozzle. Control logic 25 preferably propagates control signals that indicate which nozzles are to fire during a given firing interval. Adjustment logic 40 preferably adjusts a firing signal (e.g., the output of firing signal logic 30) such that an ink drop expelled as a result of that firing signal is of an appropriate size and happens at an appropriate moment in time. Additional adjustment logic 40', 40", etc., may be provided on the printhead dies to provide more localized firing signal adjustment.

While the firing signal logic and adjustment logic, etc., are shown in FIG. 1 as being within the printheads, it should be recognized that one or more of these items may be provided in controller 15. To implement these or related features within controller 15 a suitably fast master clock is preferably provided. EMI suppression is also preferably provided.

Embodiments of adjustment logic 40 that provide adjustment of the length of the firing signal and when the firing signal occurs are now provided.

Figure 2:
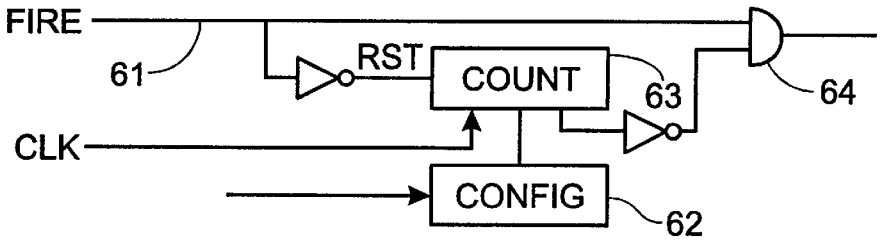
FIG. 2 is a schematic diagram of a firing signal adjustment circuit in accordance with the present invention.

Referring to FIG. 2, a schematic diagram of a firing signal adjustment circuit in accordance with the present invention is shown. The circuit of FIG. 2 preferably includes an input 61, a configuration register 62, a counter 63 and a gate (an AND gate) 64 for gating passage of the firing signal. The embodiment of FIG. 2 is a "front trimming" circuit because the circuit trims the time from the front end of the input firing signal. A "back trimming" circuit is shown in FIG. 3.

A value indicative of the amount of time to subtract from the front of the firing signal is loaded into configuration register 62. It should be recognized that configuration value for each printhead (or for particular regions of a printhead as discussed below) can be determined during test (for example, compared to a standard) and then programmed into configuration register 62 using known techniques. This loaded value is then provided as an initial value to countdown counter 63.

An input firing signal is propagated to both AND gate 64 and counter 63. When the firing signal is low, the counter is loaded with the configuration value and does not count. When the firing signal transitions high, the firing signal begins to count. During this count, the output of the counter is such that gate 64 does not pass the firing signal. After counter 63 has counted down the loaded value, gate 64 enables passage of the firing signal for the remainder of its duration. For example, if the original firing signal is 20 clock cycles in duration and the value loaded in register 62 is indicative of a delay of five clock cycles, then the firing signal will not pass AND gate 64 until after a delay of five clock cycles has been counted down by the counter and thus, the duration of the passed firing signal is only 15 clock cycles in length.

Figure 3:
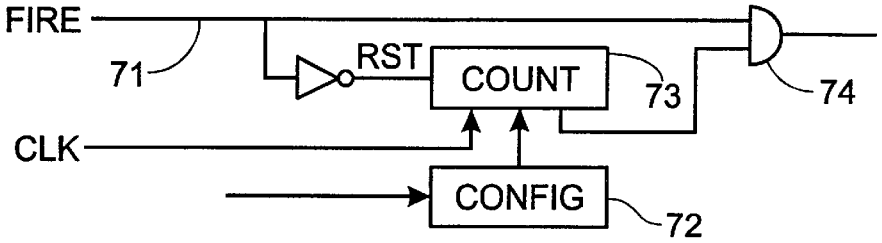
FIG. 3 is another embodiment of a firing signal adjustment circuit in accordance with the present invention.

Referring to FIG. 3, another embodiment of a firing signal adjustment circuit in accordance with the present invention is shown. The circuit of FIG. 3 is similar to that of FIG. 2, but it is a back trimming circuit. The circuit of FIG. 3 preferably includes an input 71, a configuration registration 72, a counter 73 and a gate (an AND gate) 74. In circuit 70, a value equal to the desired duration of the firing signal is loaded in configuration register 72 and provided to counter 73 for comparison. An input firing signal is passed to counter 73 and through gate 74 initially. The counter keeps gate 74 enabled for the amount of time indicated in configuration register 72. When the count expires, gate 74 is effectively disabled and the firing signal is terminated. Similar to the above example, if a firing signal of 15 clock cycles is desired, then this value is loaded into configuration register 72 and the firing signal is terminated at this number of clock cycles due to the expiration of the count in counter 73.

Figure 4:
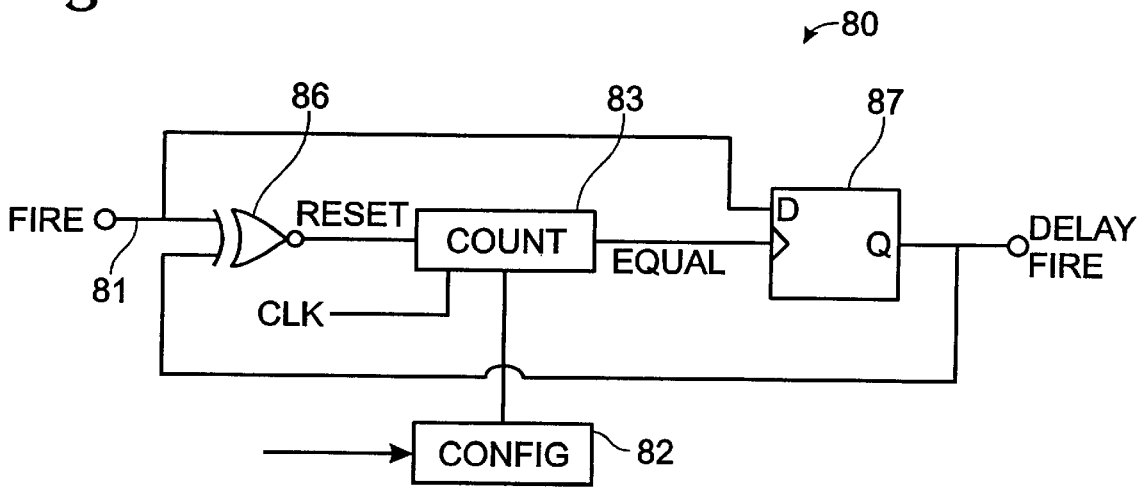
FIG. 4 is a diagram of a firing signal time modification circuit in accordance with the present invention.
Figure 5:
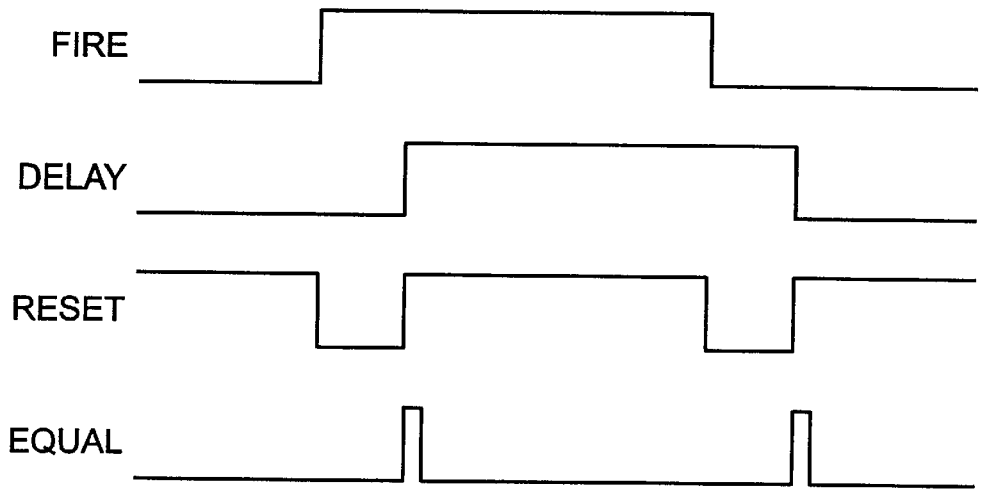
FIG. 5 is a timing diagram that corresponds to the circuit of FIG. 4.

Referring to FIG. 4, a diagram of firing signal time modification circuit 80 in accordance with the present invention is shown. Referring to FIG. 5, a timing diagram for circuit 80 of FIG. 4 is shown. Circuit 80 preferably includes a configuration register 82, a counter 83 (which in the embodiment of FIG. 4 happens to be an up counter, hence the signal equal), an exclusive NOR (exNOR) 86 and a flip-flop (a clocked latch) 87. The firing signal is input to exNOR 86 and flip-flop 87. The output delayed firing signal is fedback to the exNOR. Counter 83 receives a reset signal from the exNOR, a clock signal and a count value from configuration register 82. The output of the counter is coupled to the clock input of flip-flop 87.

As indicated by the firing diagram, when the firing signal goes high, RESET goes inactive and the count begins. When count equals the configuration value, EQUAL goes high, latching the value at flip-flop 87. EQUAL is high for as long as it takes for the latch signal to feedback and reset counter. When the firing signal goes low, RESET is again deactivated, causing a delay equal to the count value to expire before the firing signal end is latched through by flip-flop 87.

With respect to determination of configuration value for the embodiment of FIGS. 2–4, these may be determined in a plurality of ways, including, but not limited to, the following. Each printhead can be tested, compared to a standard and then provided with a value that compensates for differences from the standard. In the case of a curved printing surface, the value indicative of the requisite offset can be determined and loaded in each of the appropriate printing devices. Other scenarios include providing a user with a variety of test prints and permitting the user to select the test print they prefer. Logic in the host for controller 15, then propagates value corresponding to the selected print to the configuration register(s), etc.

While the invention has been described in connection with specific embodiments thereof, it will be understood that it is capable of further modification, and this application is intended to cover any variations, uses, or adaptations of the invention following, in general, the principles of the invention and including such departures from the present disclosure as come within known or customary practice in the art to which the invention pertains and as may be applied to the essential features hereinbefore set forth, and as fall within the scope of the invention and the limits of the appended claims.

What is claimed is:

1. A printing apparatus, comprising:

a first plurality and a second plurality of ink drop ejecting mechanisms;

firing signal generating logic that generates a firing signal for each of these ink drop ejecting mechanisms; and firing signal adjusting logic coupled to said firing signal generating logic that causes production within the same firing interval of a firing signal for said first plurality of said ink drop ejecting mechanisms that is different than a firing signal for said second plurality of said ink drop ejecting mechanisms, the firing signals being different in at least one of the group of differences including:

duration of firing signal; and time of occurrence of firing signal.

2. The apparatus of claim 1, wherein the difference between firing signals for said first and second pluralities of ink drop ejecting mechanisms is intended to cause ink drops from said first and second pluralities of ink drop ejecting mechanisms to have a desired size relationship at a given print medium.

3. The apparatus of claim 1, wherein the difference between firing signals for said first and second pluralities of ink drop ejecting mechanisms is intended to cause ink drops from said first and second pluralities of ink drop ejecting mechanisms to arrive at a given print medium at approximately the same time.

4. The apparatus of claim 1, wherein said first and second pluralities of ink drop ejecting mechanisms are provided on separate semiconductor substrates.

5. The apparatus of claim 1, wherein said adjustment logic is programmable to create a firing signal for one or more of said ink drop ejecting mechanisms that is adjusted in length and/or in time of occurrence by a programmed value.

6. A printing apparatus, comprising:

a plurality of printing devices each having a semiconductive substrate with ink expulsion elements formed therein;

firing signal generation logic coupled to each printing device that generates a firing signal for said ink expulsion elements; and firing signal adjustment logic coupled to the firing signal generation logic and a given plurality of ink expulsion elements, said firing signal adjustment logic achieving a modification of the firing signal for said given plurality of ink ejection elements based on a programmed adjustment value.

7. The apparatus of claim 6, wherein said firing signal adjustment logic is provided in at least a first of said semiconductor substrates.

8. The apparatus of claim 7, further comprising firing signal adjustment logic in a second of said semiconductor substrates.

9. The apparatus of claim 7, wherein said firing signal adjustment logic achieves modification of the firing signal of said given plurality of said expulsion elements relative to the firing signal of another plurality of said expulsion elements.

10. The apparatus of claim 6, wherein said firing signal for said given plurality of ink expulsion elements is modified so as to achieve ink drops from these ink expulsion elements and from another of said ink expulsion elements that are of approximately the same size.

11. The apparatus of claim 6, further comprising firing signal adjustment logic in all of said semiconductor substrates.

12. The apparatus of claim 6, wherein said firing signal adjustment logic adjusts the length of the firing signal for said given plurality of ink expulsion elements.

13. The apparatus of claim 6, wherein said firing signal adjustment logic adjusts the time of occurrence of the firing signal for said given plurality of ink expulsion elements.

14. The apparatus of claim 6, wherein the amount of modification provided by said firing signal adjustment logic is programmable.

15. A method of registering a multiple printhead printing device apparatus, comprising the steps of:

providing a printing apparatus with firing signal generation logic and a plurality of ink expulsion elements coupled thereto;

providing firing signal adjustment logic coupled to said firing signal generation logic and a first plurality of said ink expulsion elements; and programming a value to said firing signal adjustment logic that is indicative of a timing adjustment to be made to a firing signal for said first plurality of said ink expulsion elements that is generated by said firing signal generation logic.

16. The method of claim 15, wherein said programming steps further include the step of programming said firing signal adjustment logic so as to adjust a duration of said firing signal.

17. The method of claim 15, wherein said programming steps further include the step of programming said firing signal adjustment logic so as to adjust the time of occurrence of said firing signal.

18. A printing apparatus, comprising:

a first ink drop expulsion element formed in a semiconductor substrate;

a second ink drop expulsion element formed in a semiconductor substrate;

firing signal generation logic that generates a firing signal for each of said first and second ink drop expulsion elements; and firing signal adjusting logic coupled to said firing signal generating logic and said first ink drop expulsion element that receives a firing signal for said first ink drop expulsion element and modifies the time of occurrence of at least one of the transition edges of that firing signal relative to the time of occurrence of the transition edge as input so as to compensate for a physical difference between the first and second ink drop expulsion elements.

19. The apparatus of claim 18, wherein said physical difference is at least one of the physical differences including:

the size of the first and second ink drop expulsion elements is different; and the distance between the first and second ink drop expulsion elements as positioned in the printing apparatus and a print medium is different.

20. A printing apparatus, comprising:

a plurality of printing devices provided respectively in a plurality of semiconductive substrates that each have ink expulsion elements formed therein;

firing signal generation logic coupled to each printing device that generates a firing signal for said ink expulsion elements; and firing signal adjustment logic coupled to the firing signal generation logic and a given ink expulsion element, said firing signal adjustment logic achieving a modification of the firing signal for said given ink ejection element based on a programmed adjustment value;

wherein said firing signal adjustment logic is provided in at least a first of said semiconductor substrates.

21. The apparatus of claim 20, further comprising firing signal adjustment logic in a second of said semiconductor substrates.

22. The apparatus of claim 20, further comprising firing signal adjustment logic in each of said plurality of said semiconductor substrates.

* * * * *